US008471137B2

(12) United States Patent
Adair et al.

(10) Patent No.: US 8,471,137 B2
(45) Date of Patent: Jun. 25, 2013

(54) PICKUP SYSTEM WITH A CARTRIDGE

(76) Inventors: Kenneth Michael Adair, Humble, TX (US); Steven Nolan, Humble, TX (US)

( * ) Notice: Subject to any disclaimer, the term of this patent is extended or adjusted under 35 U.S.C. 154(b) by 190 days.

(21) Appl. No.: 13/032,575

(22) Filed: Feb. 22, 2011

(65) Prior Publication Data

US 2012/0210847 A1 Aug. 23, 2012

(51) Int. Cl.
*G10H 3/18* (2006.01)

(52) U.S. Cl.
USPC ..... 84/726

(58) Field of Classification Search
USPC ..... 84/726
See application file for complete search history.

(56) References Cited

U.S. PATENT DOCUMENTS 3,624,264 A 11/1971 Lazarus
4,145,944 A * 3/1979 Helpinstill, II ..... 84/726
4,819,537 A * 4/1989 Hayes et al. ..... 84/736
5,276,276 A 1/1994 Gunn
5,641,932 A 6/1997 Lace
5,898,121 A 4/1999 Riboloff
5,925,839 A 7/1999 Schertler
7,060,888 B2 * 6/2006 Spalt ..... 84/727
7,132,597 B2 11/2006 Hosler
7,291,780 B2 11/2007 Hosler
7,667,128 B2 2/2010 Hosler

* cited by examiner

*Primary Examiner* — Jianchun Qin
(74) *Attorney, Agent, or Firm* — Andrew W. Chu; Craft Chu PLLC

(57) ABSTRACT

The present invention is a pickup system including a transducer, a mount, and a cartridge for modifying perceived sound from a musical instrument. The transducer includes a housing, a magnet and an electric signal carrier. The mount attaches the transducer to the instrument. The cartridge includes a container and attachment device, which positions the container in proximity to the transducer. The attachment device engages the container with the transducer so as to affect the electric signal created by the instrument. The cartridges and container can be either integral or interchangeable to vary resonance materials to the transducer. The container may be filled with another material, including ferromagnetic fluid for an induced magnet effect upon the perceived sound from the transducer.

17 Claims, 6 Drawing Sheets

PICKUP SYSTEM WITH A CARTRIDGE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to an electromagnetic device that converts sounds and mechanical vibrations from a musical instrument into an electrical signal. In particular, the pickup system of the present invention includes a cartridge to enhance conversion of an input from the musical instrument to the electrical signal.

2.Description of Related Art Including Information Disclosed Under 37 CFR 1.97 and 37 CFR 1.98.

The pickup known in the prior art normally includes a transducer, a permanent magnet wrapped with thousands of turns of wire. The magnet and coil of wire are mounted on the body of the instrument. The location varies, depending upon the features of each instrument. The pickup can be attached to the bridge, neck, pickguard, sound hole, etc. A vibration of the instrument interacts with the magnetic field of the transducer so as to induce an alternating current through the coil of wire. This electrical signal travels by cable for amplification, broadcasting, or recording or other use. The general and well established concept is formation of a magnetic circuit, wherein magnetic flux through the transducer is caused by input from the musical instrument. The basic induction of current is moving the coil around the magnet, wherein vibration of the coil around the magnet generates current through the wire. Vibration pickups rely upon this magnetic flux of the magnet by physical vibration of the coil. Sensitivity of the coil vibrations detect different sound vibrations, which affects the signal generation and quality of sound picked up through the system.

Another prominent conventional pickup system is a magnetic pickup, in which the movement of magnetic instrument strings through the magnetic field of a transducer causes a disruption of the magnetic field of the transducer. A variable current flows in the coil windings corresponding to that disruption of the magnetic field, which represents the sound of the string movement. More particularly, a transducer for converting between magnetic field disruptions and electrical signal can convert the magnetic string movements into a pattern of variations in the electrical signal.

The other prominent conventional pickup system is a piezoelectric pickup, in which pressure variations in the form of sound act on two opposing faces of a piezoelectric element to generate electric charge within the piezoelectric element. The piezoelectric pickups are typically used for acoustic guitars and stringed instruments with a bridge, like the cello and violin. The placement on the bridge is recommended because stronger vibrations occur at the bridge. The transduction of sound into an electrical signal does not rely upon the magnetic field of the transducer. It is also possible for hybrid pickups to include any combination of vibration, magnetic and piezoelectric systems.

In the past, various U.S. patents have been granted in the field of pickup devices. For example, U.S. Pat. No. 3,624,264 issued to Lazarus on Nov. 30, 1971 teaches a vibration transducer for detecting vibrations in general and sound from a musical instrument. The invention shows three piezoelectric vibration detectors oriented to detect vibrations along all three orthogonal axes established by walls of a sealed chamber.

U.S. Pat. No. 5,276,276 issued to Gunn on Jan. 4, 1994 discloses a coil transducer, relying upon the vibration of a coil around a magnet to induce current. In the invention, a pair of coils directly connects to the resonating surface of a musical instrument. The vibration of coils correlates to the resonating surface in the vicinity of a magnet.

U.S. Pat. No. 5,898,121 issued to Riboloff on Apr. 27, 1999 discloses an electrical musical instrument pickup system including switchable series-connected hum-canceling windings. There is a single-coil magnetic pickup mounted on the guitar beneath strings of the guitar including a single coil windings and magnets, and a second single-coil magnetic pickup mounted beneath the strings of the guitar with magnets oriented in opposite alignment to the first pickup's magnets in what is known as a 'humbucking' or 'hum canceling' arrangement. The invention presented a solution to the extra vibrations being picked up by the transducer, and a switch allows a dampening of the extraneous hum sound.

U.S. Pat. No. 5,925,839 issued to Schertler on Jul. 20, 1999 teaches a bridge with a piezoelectric pickup. The piezoelectric pickup can be used with acoustic instruments without feedback problems or interference from magnetic fields of other devices. The '839 patent discloses an air chamber adjacent to the transducer.

U.S. Pat. No. 5,641,932 issued to Lace on Jun. 24, 1997 discloses a sensor assembly for stringed musical instruments. The invention addresses the problems of a vibration piezoelectric pickup with non-magnetic instrument strings. The strings are not equidistant to the piezoelectric sensor, so that distortion occurs. The present invention uses a resonator plate for a refined sound. The resonator plate is also compatible with electric guitars in a hybrid system.

There are also a series of patents by Hosler (U.S. Pat. No. 7,132,597 issued on Nov. 7, 2006;U.S. Pat. No. 7,291,780 issued on Nov. 6, 2007;and U.S. Pat. No. 7,667,128 issued on Feb. 23, 2010) teaching transducers for converting between mechanical vibration and electrical signal. The '597 patent discloses a transducer with a magnet and coil in a housing filled with damping fluid. The magnet and coil vibrate relative to each other. The '780 patent claims a transducer with a magnet in side-to-side polar orientation and restricted linear and rotational movement through the coil. The housing may also be filled with fluid. The '128 patent shows another transducer with the magnet and any electrical signal carrier connected and vibrating relative to each other in a housing filled with fluid. The patents disclose variations of magnet types and electrical signal carrier types vibrating in a housing filled with damping fluid.

The prior art pickup systems each have particular drawbacks which impact the sound quality transmitted by the instrument. The magnetic pickup requires ferromagnetic strings. Strings fabricated from synthetic or organic materials are not magnetically susceptible and, therefore, do not affect the magnetic field. The sound qualities of non-ferromagnetic strings are not compatible with the magnetic pickups. Other qualities of the string movement are also not detectable by the magnetic field created by these electromagnetic sensors, such as the sound waves directly produced by the movement of the strings through the air.

Vibration pickups are limited in range by placement. String sensing transducers have traditionally given a fair representation of sound; however, they are limited in range to string movement alone. Sound from subtle vibrations in the instrument's body materials, shape of the instrument cavity or other important aspects of the instrument sound, are not detected, when the vibration pickup is not physically close enough. Vibration pickups, attached at different locations to the instrument's body or soundboard, are susceptible to dampening, which results from the musician simply holding the instrument or gripping the instrument. Piezoelectric pickups suffer from the same problem of proximity to the sound source, and they also tend to produce an unattractive sound distortion that can be especially problematic when amplified.

In any prior art system, there is no pickup capable of transducing ferromagnetic string movements through a magnetic field, vibrations from the body of the instrument, sound waves produced by the moving strings and sound waves projected from the sound hole or body of the instrument. Each prior art pickup contains permanent components, such as a permanent magnet, coils, cylindrical housing, damping fluid, etc. The permanent structures produce a known sound quality from the musical instrument, even if such sound quality is an incomplete profile of the musical instrument. A magnetic pickup with ferromagnetic strings will only produce electric signals from those strings, so vibration of the instrument body will not affect those electric signals. The operator can compensate for this feature of the pickup system attached to the particular instrument.

If a more complete profile or a different profile of the instrument is desired, then the pickup system must be changed to transduce more or different sound characteristics beyond the limitation of the particular pickup only. At this time, there is no pickup system to allow such changes to the pickups. All prior art pickup systems are fixed, requiring expertise for removal and installation. A switch from a magnetic pickup to a piezoelectric pickup requires the instrument to be disassembled and re-assembled. The placement of the piezoelectric pickup is different from the magnetic pickup because of the need for proximity to the mechanical vibration. There is a need for a pickup system with an easier exchange of pickups for an easier adjustment of desired sound quality from the instrument.

It is an object of the present invention to provide a pickup system that responds directly to ferrous string movement through a magnetic field, mechanical vibration from the body of the instrument, sound waves due to string movement through the air near the pickup and vibrations from sound waves emitted from the body of the instrument.

It is an object of the present invention to provide a pickup system to transduce sound waves and vibrations caused by string movement and mechanical vibration from the body of the instrument, when the strings are not ferromagnetic.

It is another object of the present invention to provide a pickup system with a vibrational pickup placed in close proximity to the instrument strings in order to transduce string movement into the electrical signal.

It is another object of the present invention to provide a pickup system with an induced magnetic field component, being responsive to variations in ferrous string movements, wherein the mechanical vibrations due to body resonance, sound waves from the moving strings and even sound waves emitted from the body of the instrument each affect and slightly alter the variable magnetic field.

It is still another object of the present invention to provide a pickup system with compatibility to transduce tones of different materials according to individual preferences.

It is still another object of the present invention to provide a pickup system to enhance selection of a sound profile or perceived sound of an instrument by applying different resonant materials with respective sound quality characteristics.

It is another object of the present invention to provide a pickup system with an induced magnetic field component, wherein mechanical vibrations due to resonance of the material of the cartridge or container affect the variable magnetic field.

It is still another objection of the present invention to provide a pickup system to convert resonance properties from particular materials into effects detectable by a magnetic field.

It is an object of the present invention to provide a pickup system with a cartridge means which can be removably attached. Each cartridge is comprised of a container with a different effect on the electrical signals transmitted from the instrument. The container can also be removably attached to the cartridge means.

It is an object of the present invention to provide a pickup system with a cartridge means having an induced magnetic field to affect the perceived sound of the instrument.

It is an object of the present invention to provide a pickup system with a cartridge means having a container filled with a ferromagnetic fluid to induce a magnetic field to affect perceived sound of the instrument.

It is an object of the present invention to provide a pickup system with a cartridge means having a container filled with a ferromagnetic fluid and made of a resonant material to affect perceived sound of the instrument.

It is another object of the present invention to provide a pickup system with a cartridge means which is easily replaced and interchangeable.

It is another object of the present invention to provide a pickup system with a cartridge means with interchangeable containers.

It is still another object of the present invention to provide a pickup system with a cartridge means which can be removably attached and de-tached without any disassembly of the instrument.

It is still another object of the present invention to provide a pickup system which can easily change the perceived sound of the instrument.

These and other objectives and advantages of the present invention will become apparent from a reading of the attached specifications and appended claims.

SUMMARY OF THE INVENTION

The present invention is a pickup system with a cartridge for modifying perceived sound from a musical instrument. The pickup system includes a transducer, a mounting means, and a cartridge. The transducer comprises a housing, a magnet and an electric signal carrier, such as a coil of wire. The mounting means attaches the transducer to the instrument. The mounting means can also be removed so that the device can be detached from the instrument. The cartridge includes a container and attachment means, which positions the container in proximity to the transducer. The attachment means can removably engage the container with the cartridge, and the cartridge can removably interact with the transducer so as to affect the electric signal created by the instrument by interchangeable parts with different resonant properties.

The mounting means includes a threaded member engaging the housing of the transducer. The mounting means can also attach to known parts of the instrument, such as the instrument body, the pickguard, or sound hole of an acoustic guitar. The housing of the transducer is movable along an axis of the threaded member, so that the pickup system is adjustable relative to the instrument. The pickup system can be moved closer or farther from the instrument in order to optimize the sound and vibration input to the system. The mounting means can attach to a bottom surface or top surface of an instrument body. For an acoustic instrument with a sound hole, the mounting means can include a support means and an adjustment means, wherein the support means attaches to the edges of the sound hole and wherein the separate adjustment means moves the transducer relative to the instrument.

The container of the present invention provides resonant input to affect the transducer, which influences the perceived sound of the instrument. Variation of the container allows the operator to change the sound quality without changing the entire pickup. The container can be comprised of a first material and filled with a second material. Since the first material and the second material affect the electric signal, the variation of these materials creates different perceived sounds according to the preference of the operator. For example, a sealed container can contain a fluid, such that both the container material and fluid affect the electric signal produced by the transducer. Also, when the fluid is a ferromagnetic fluid, an induced magnetic field from the ferromagnetic fluid can augment the input to the transducer. For a magnetic pickup with ferromagnetic strings, the combined induction from the strings and effects of the induced magnetic field from the ferromagnetic fluid achieves a perceived sound from the instrument that is not possible with the prior art. The transducer must also be sufficient strong to detect this input from a distance. Further variations of the container include different shapes of containers, resonant structures mounted within the container, a plurality of chambers, arrangement of chambers, subdivision of chambers, different filling materials for chambers, and different shapes of chambers. Use of more than one container at a time is also possible.

The present invention also covers the method of using the pickup system, including installing a transducer onto an instrument body of a musical instrument; attaching a first cartridge in a fixed position relative to the transducer; detecting and converting sound and vibrations from the musical instrument into an electric signal for amplification, broadcasting, and recording; and removing the first cartridge. Subsequent cartridges can be attached and removed according to the preference of the operator. The method of using a pickup system attaches and removes the cartridge or container without requiring disassembly or major modification of the musical instrument.

DETAILED DESCRIPTION OF THE DRAWINGS

Figure 5B:
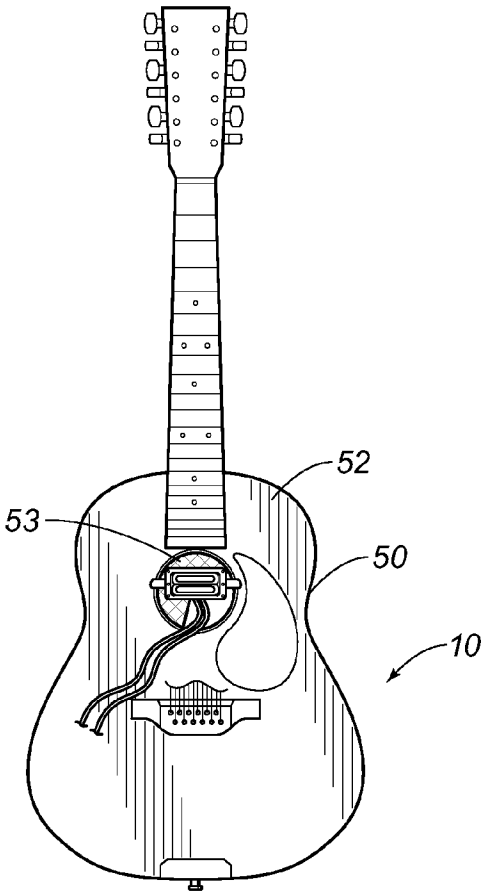
FIGS. 5*a*-5*b* show schematic views of the pickup system of the present invention as installed on an electric guitar and an acoustic guitar, respectively.
Figure 5A:
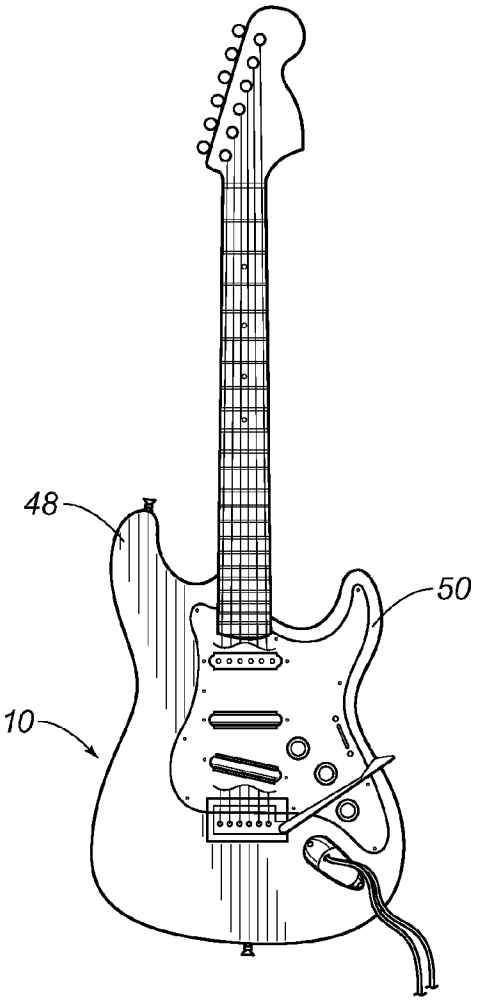

Referring to FIGS. 5*a*-5*b*,the pickup system 10 of the present invention detects and converts sound and vibrations from a musical instrument 48 into an electric signal for amplification, broadcasting, and recording. The pickup system 10 attaches to the instrument body 50, so that sound and vibration input enables the pickup system 10 to create a perceived sound. FIG. 5*a* shows attachment to an electric guitar 48, and FIG. 5*b* shows attachment to an acoustic guitar 52. The placement of the pickup system 10 affects the type of input for creating the perceived sounds, consistent with the known prior art pickup systems. FIG. 5*b* also shows a mesh screen 53 to prevent the pickup system 10 from falling into the body of the guitar. The mesh screen 53 is an accessory to the pickup system 10, which has utility for several types of instruments. The present invention retains the ability for variable placement for affecting perceived sound so that an operator can adjust the present invention according to individual preferences. The figures also show environmental details of the instruments and electrical connections for illustrative purposes only.

As shown in FIGS. 1-3B, the pickup system 10 includes a transducer means 12, a mounting means 20, and a cartridge means 24. The transducer means 12 is comprised of a housing 14, a magnet 16 and an electric signal carrier 18 and creates a magnetic field. The magnet 16 can be a permanent magnet, such as rare earth material magnet. The magnet 16 is also a fixed magnet that does not rotate or move within the housing 14. The magnet 16 can also include steel poles wrapped by wire with a large ceramic magnet underneath. The electrical signal carrier 18 can be a coil of wire, and the wire is usually wound around the magnet 16. In the present invention, the coil of wire can have a ratio of coil inductance to resistance of at least 0.15, wherein the coil inductance in Henrys is divided by coil resistance in Kohms measured at 1 Khz. For example, the coil of wire can have a resistance of at least 6500 Ohms for single coils utilized in a guitar pickup. The guitar can house the transducer 12 with the required amount of windings for 6500 Ohms and the cartridge means 22.

The particular number of windings and coil resistance in Ohms may vary according to instrument, consequent space availability for the invention, and desired sound properties; however, the ratio of coil Inductance to Resistance is maintained for the pickup system 10 of the present invention. When the magnet 16 is comprised of a fixed magnet, the north and south poles of the magnet 16 are aligned generally perpendicular to the coil. There are other possible transducer means 12 covered by the present invention, wherein mechanical energy is converted into an electric signal, although not shown in the drawings.

The magnetic field of the transducer 12 has a magnetic field strength of at least 550 Gauss at a surface of the housing 14. The magnetic field strength can be achieved by strong permanent and fixed magnets and the number of windings of the coil of wire. For example, the coil of wire can have a resistivity of about 6500 Ohms and compatible magnets of a suitable strength. For 550 Gauss at the surface of the housing 14, magnets with remanence or residual magnetization levels of $B_R$=3400 gauss or greater can be used. Other variations in transducer 12 shape, size, windings, materials and magnet strength can be adjusted for the type of instrument and type of perceived sound of the instrument. Importantly, the magnetic field of the transducer 12 of the present invention is significantly stronger than the prior art pickup systems. Embodiments of the present invention typically use strong magnets with remanence greater than $B_R$=3400,such that the windings to achieve the desired magnetic field strength fit in the space allotted in an acoustic or electric guitar. Other instruments may have different space constraints with more or less room for windings and different magnets with more or less remanence. The housing 14 may have shielding around the magnet and electric signal carrier to protect from heat and noise greater than prior art systems. The transducer 12 of the present invention of this strength is positioned at a distance from the cartridge means 24 so that any induced magnetic field of the cartridge means is complementary to the magnetic field of the transducer means. The magnetic field of the transducer 12 of the present invention is suitable for placement further from the instrument body parts and the other parts of the system 10 than the prior art. In this manner, the cartridge means 24 can be placed above or below the transducer 12, depending upon the structure and space available in the instrument body.

Figure 1:
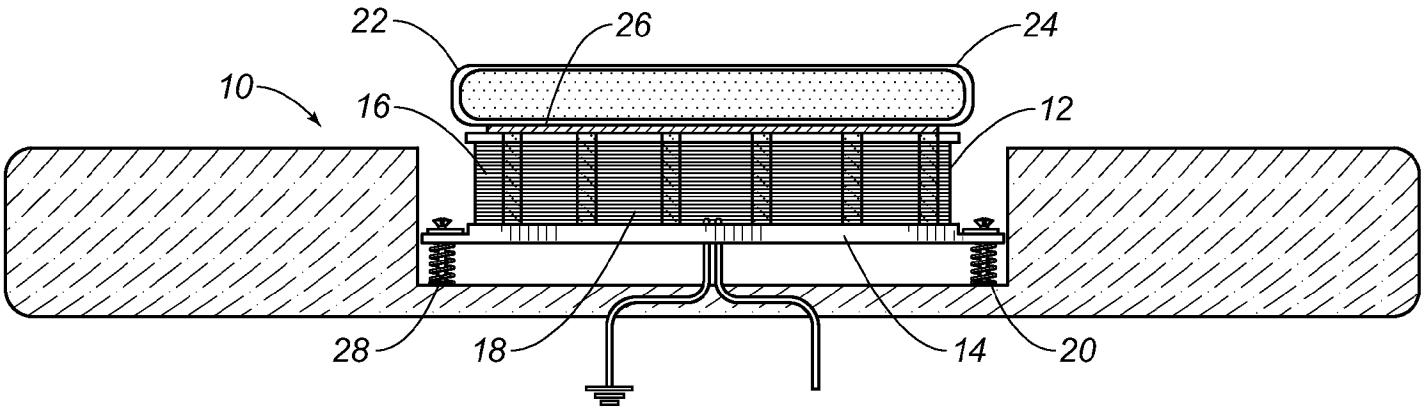
FIG. 1 is a schematic side view of the pickup system of the present invention, being shown attached to an instrument body.
Figure 2:
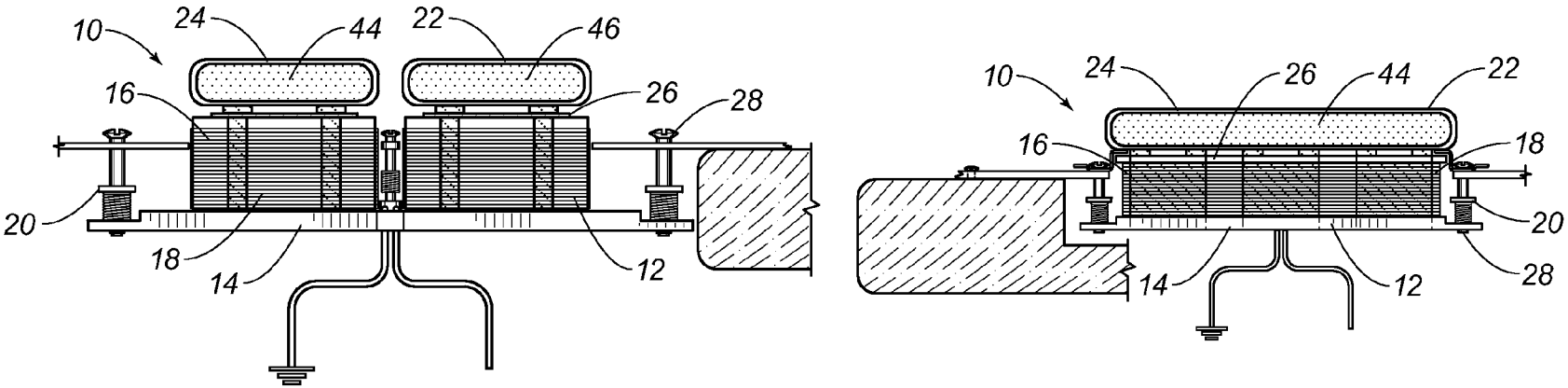
FIG. 2 are other schematic side views of the pickup system of the present invention, being shown attached to different parts of an instrument body.

The transducer 12 is positioned so as to detect movement of ferromagnetic strings of said instrument body, so that the movement of the ferromagnetic strings can be detected by the magnetic field of the transducer 12. With the stronger magnetic field, the transducer 12 can be placed a further distance from the strings. Generally, magnetic field strength of at least 180 Gauss at the strings is sufficient for detecting any induced effects of the strings. The strength of the magnetic field of the transducer 12 of the present invention is relevant to fit the cartridge means 24 between the transducer 12 and the strings and retain the detection of magnetic field effects of the strings by the transducer 12, as shown in FIGS. 1-3. The transducer 12 must also be strong enough to be separated from the strings, yet detect the strings, even if the cartridge means 24 is placed underneath the transducer 12.

FIGS. 1 and 2 further show the mounting means 20 removably attached to the transducer means 12. The ends of the housing 14 of the transducer means 12 have threaded holes for insertion of the mounting means 20. The other end of the mounting means 20 can fixedly attach to the instrument body. The placement on the instrument body is variable by preference of the operator, according to the effect on perceived sound. The mounting means 20 is comprised of a threaded member 28 engaging the housing 14 of the transducer means 12. The housing 14 is movable along an axis of the threaded member 28. As such, the pickup system 10 is adjustable relative to the parts of the instrument. FIG. 1 shows the threaded member 28 removably attached to a bottom surface of the instrument body, and FIG. 2 shows the threaded member 28 removably attached to a top surface structure of the instrument body. In either view, the housing 14 is adjustable relative to the instrument along the axis of the mounting means 20.

This movement of the pickup system 10 of the present invention allows for changing perceived sound by varying the space between the instrument structures and the transducer means 12. Beyond the prior art, this movement of the pickup system 10 also allows for installing and changing the cartridge means 24 without dismantling the instrument every time a new perceived sound is desired from a different cartridge means 24. The pickup system 10 can be moved further from the strings for manual exchange of a new cartridge means 24.

Figure 3A:
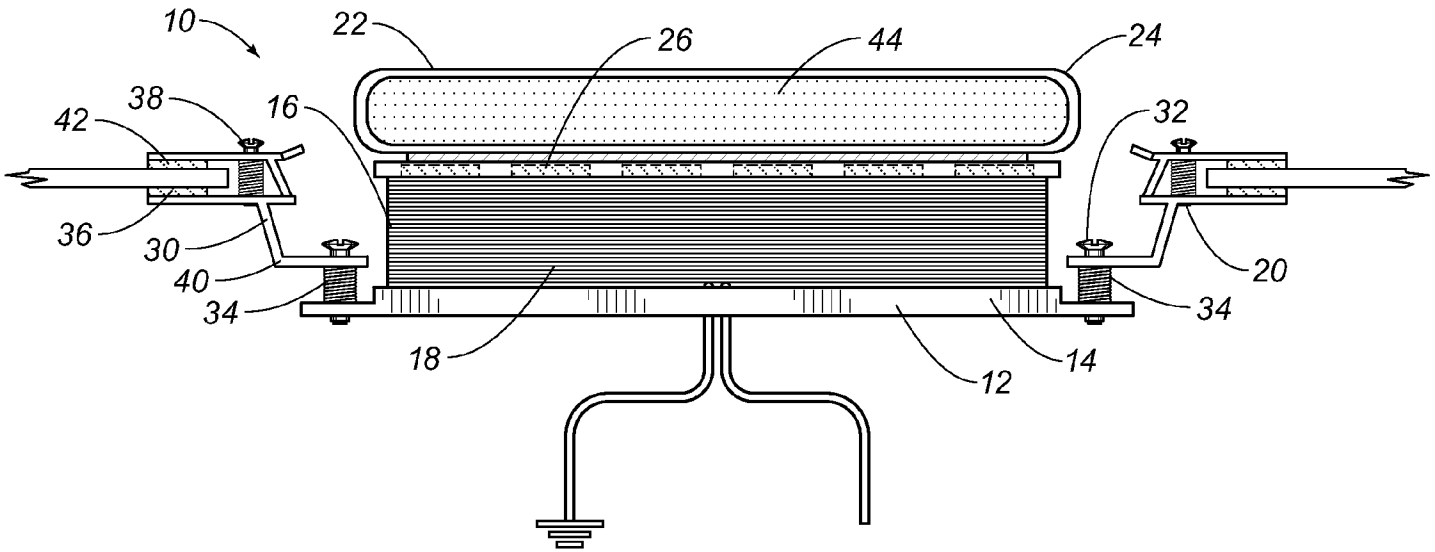
FIG. 3A is still another schematic side view of the pickup system of the present invention, being shown with a mount with a support member and adjustment means.
Figure 3B:
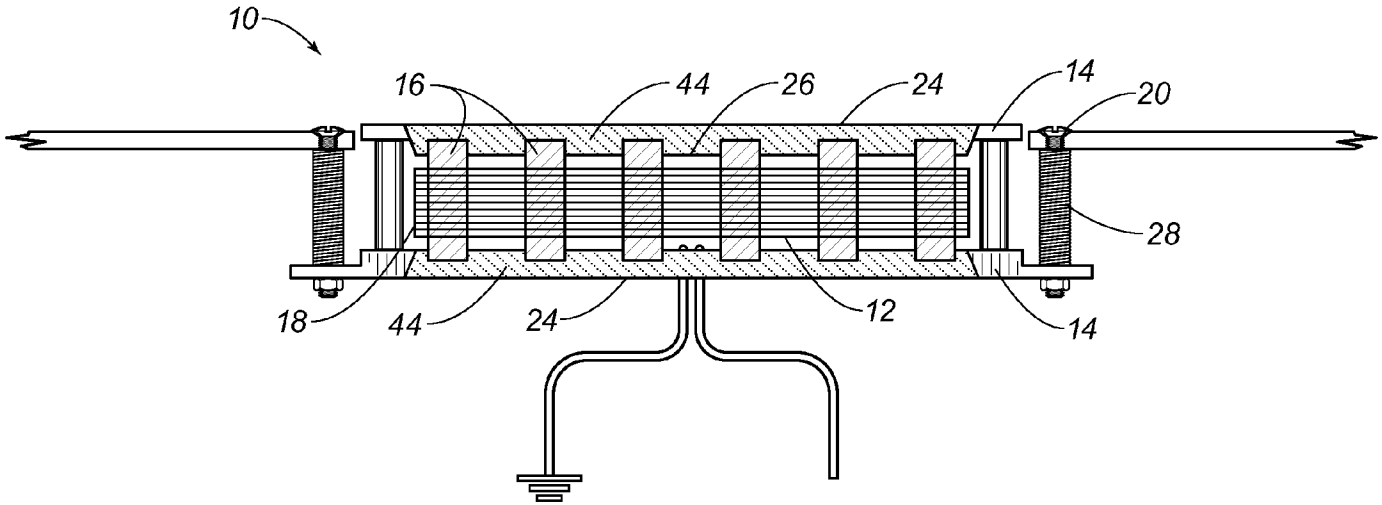
FIG. 3B is yet another schematic side view of the pickup system of the present invention, being shown with a container within the housing or very close to the housing.

FIGS. 3A and 3B show the pickup system 10 with a mounting means 20 in the sound hole of an instrument, such as an acoustic guitar. The mounting means 20 comprises a support means 30 and an adjustment means 32. Instead of the threaded member, the mounting means 20 of FIG. 3A has an adjustment means 32 with a threaded element 34 engaging the housing 14 of the transducer means 12 and the support means 30. Similarly, the housing 14 of the transducer means 12 is movable along an axis of the threaded element 34. The adjustment means 32 preserves the mobility of the pickup system 10 of the present invention for a different attachment to the instrument. The support means 30 includes known mechanical devices, such as friction-fit abutment members, rubber gaskets, or mechanical clamps. FIG. 3A shows an example of a support means 30 with a plurality of clamping arms 36, a locking screw 38, and a flange member 40. The threaded element 34 of the adjustment means 32 engages the flange member 40, anchoring the pickup system 10 to the instrument. The clamping arms 36 are shown with padding 42, which can protect the instrument from damage and which can also contribute to perceived sound from the instrument. The support means 30 includes any friction-fit attachment, such as a rubber gasket, or other device for fixed mounting on the instrument body. FIG. 3B shows an example of a cartridge means 24 having a container 22 with a fluid above the transducer 12 and below the transducer 12. The attachment means 26 to the transducer 12 is within the housing 14 and adjacent the magnets 16, when the structure and space available in the instrument body is very limited.

The pickup system 10 of the present invention also includes the cartridge means 24, which is comprised of a container 22 and an attachment means 26. The cartridge means 24 is positioned in proximity to the transducer means 12 so that resonance of the cartridge 24 affects the perceived sound of the instrument. The cartridge means 24 can be removably attached to the transducer means 12 so that different cartridges can be switched to affect the perceived sound. The movement of the transducer means 12 relative to the instrument can also move the cartridge 24 so that the cartridge 24 can be switched without interfering with the parts of the instrument. As such, the attachment means 26 only engages the container 22 with the transducer means 12. FIGS. 1-3B illustrate padding, adhesive and dampeners as attachment means 26. Magnetic attraction is also a type of attachment means 26. The attachment means 26 can also removably attach the container 12 to the cartridge means 24 for interchangeability of the containers 22. FIG. 1 shows the attachment means 26 stacked on top of the transducer 12. FIG. 2 shows the attachment means 26 anchored to the instrument, wherein the engagement between the container 22 and the transducer means 12 is only an abutment. Any friction, snap-fit, magnetic attraction, or temporary adhesive can also be the attachment means 26. In any case, the cartridge means 24 can be integral or separately movable from the pickup system 10 of the present invention and the container 24 can be integral or separately movable from the cartridge means 24.

Referring to FIGS. 1-3B and 4a-4f, the present invention includes a cartridge means 24 having a container 22 with variable resonance, which affects the perceived sound generated by the instrument. The container 22 is comprised of a first material, and the container 22 is filled with a second material. The first material and the second material are different from each other, and the second material could also be air. The material affects the perceived sound by different resonance on the transducer 12 creating the electric signal. There are already many known manipulations and variations of pickups for a particular perceived sound by a type of material. Whether characterized as dampening or brightening, the pickup system 10 of the present invention discloses a unique and inventive structure of applying this resonance input to the transducer 12.

The container 22 may be sealed and filled with fluid 44 as shown in FIGS. 1-2. The fluid 44 imparts vibrational input to the transducer 12. Also, when the fluid 44 is ferromagnetic, an induced magnetic field further affects the electrical signal and consequent perceived sound. The induced magnetic fluid of the present invention is complementary to the magnetic field of the transducer 12. The induced magnetic field has no magnetic bearing or damping relation to the transducer 12 or the movable magnet of a transducer. The transducer 12 of the present invention does not use a movable magnet for any dampening or bearing structure or application. The present fluid 44 is not fixed or sealed with coils as a part of the transducer. Various ferromagnetic fluids are known, including suspensions of ferromagnetic solids. With ferromagnetic properties, the container 22 is placed adjacent to the transducer means 12 and aligned to magnetic poles of the magnet 16 so as to form the complementary induced magnetic field by the fluid 44. Those skilled in the art will understand that the term 'ferrofluid' is commonly used to denote a 'ferromagnetic fluid'. Ferromagnetic materials are those which can retain magnetization and become magnets. Since the ferrofluid can have induced magnetism by close proximity to a magnetic field, but cannot be permanently magnetized, it is sometimes considered and referred to as a paramagnetic material. In the present invention, ferromagnetic fluid refers to fluid which contains ferromagnetic or ferromagnetic particles, or any combination of both types of particles in suspension and which exhibits the properties of ferromagnetism or paramagnetism. The magnetic fields of the transducer 12 and cartridge means 24 are separate, and the container 22 is positioned at a distance from the transducer 12 so that the magnetic fields are complementary. For example, the cartridge means 24 is positioned in proximity to the transducer means 12 of the present invention so that the gauss level of the magnetic flux field within the cartridge means 24 is sufficiently high to achieve at least a 25% saturation magnetization level of at least a portion of ferromagnetic fluid 44. The closest proximity ferromagnetic fluid 44 within the cartridge means 24 to the highest area of magnetic flux should be such that at least a 25% saturation magnetism level or greater is achieved in the portion of ferromagnetic fluid 44 subjected to the strongest part of the magnetic flux field. As such, the induced magnetic field of the cartridge means 24 is considered to be complementary to said magnetic field of the transducer means 12.

Figure 4A:
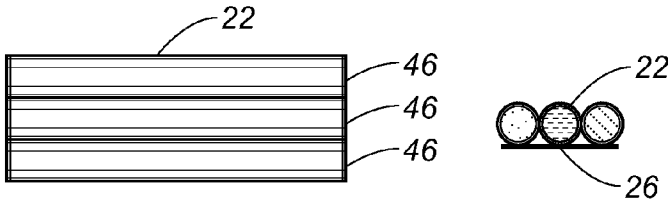
FIG. 4*a* shows end elevation and top plan views of a container of the pickup system of the present invention.
Figure 4B:
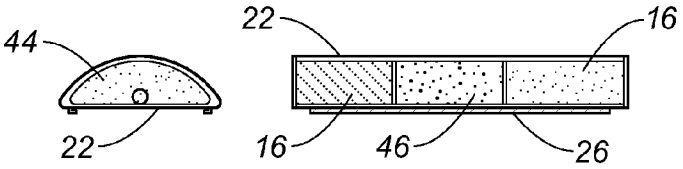
FIGS. 4*b*-4*f* show end and side elevation views of other containers of the pickup system of the present invention.
Figure 4C:
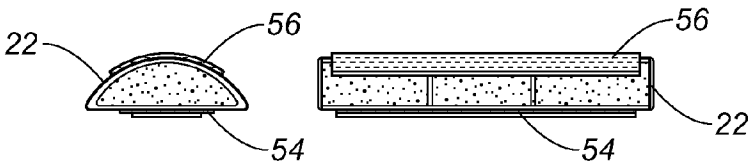

The second material in the container 22 is the filling. The second material can include a plurality of materials with resonant effects, whether the materials are mixed or layered as shown in FIG. 4*b*. Again, the effect on perceived sound by preference of the operator is a primary consideration. The pickup system 10 discloses an inventive device for interchangeable control of the perceived sound by a particular structure. The container 22 can be comprised of a plurality of chambers 46 as shown in FIG. 4*a*. These chambers 46 can be adjacent or stacked. The container 22 can also be subdivided as shown in FIG. 4*c*, wherein each subdivision is filled with a respective material. The chambers can have different sizes and positions, such as larger chambers housing smaller chambers. Each container 22 and each filling of each chamber 46 can affect the resonance and input to the transducer 12.

Figure 4D:
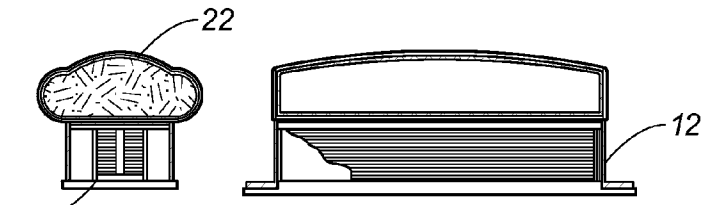

FIG. 4*d* shows a container 22 coated with a surface material. When the first material and the surface material are different from each other, the coating can affect the input to the transducer as well. An inner liner of the container 22 is also possible. Thickness of application may also be part of the container 22 of the present invention. FIG. 4*d* also shows a dampener 54 between the container 22 and the transducer 12 and a protective cover 56 on top of the container 22. FIG. 2 also shows a protective cover. FIGS. 4*b*, 4*c* and 4*d* also illustrate the different shapes of the container 22. The container 22 can have a flat side for contact with the transducer 12 and a curved side for receiving input from the instrument strings. FIG. 4*b* shows a cylindrical rod for the same exposure to both the transducer 12 and the instrument strings. The shape can impact positioning relative to the transducer 12 and have resonant effects on the perceived sound. Thus, the container 22 of the present invention affects the electric signal and perceived sound.

Figure 4E:
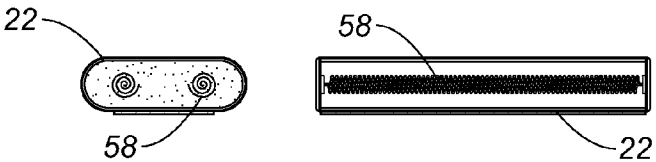
Figure 4F:
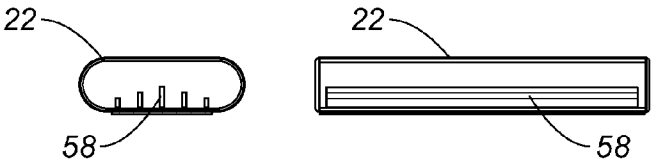

FIGS. 4*e*-4*f* illustrate the pickup system 10 of the present invention with a container 22 having a resonant member means 58 housed in an interior thereof. FIG. 4*e* shows the resonant member means 58 as a spring, and FIG. 4*f* shows the resonant member means 58 being a plurality of baffles. When the container 22 is filled with a ferromagnetic fluid 44, then the resonant member means 58 can have an additional particular effect on the induced magnetic field of the fluid and the perceived sound, depending further on the material selection of the resonant member. As such, these internal structures again affect the electrical signal and perceived sound of the instrument in an inventive way.

The present invention further includes the method of using a pickup system 10, including installation of a transducer onto an instrument body of a musical instrument, attachment of a first cartridge in a fixed position relative to the transducer, detection and conversion of sound and vibrations from the musical instrument into an electric signal for amplification, broadcasting, and recording, removal of the first cartridge, and repetition of the attachment and removal for achieving a preferred perceived sound. The step of installing a transducer includes attaching a support onto the instrument, and securing the transducer housing to the support. This attachment allows for the adjustment of the relative position of the pickup system 10 to the instrument. The position of the container allows removal and replacement without disassembly or major modification of the musical instrument.

The pickup system of the present invention responds directly to ferrous string movement through a magnetic field, mechanical vibration from the body of the instrument, sound waves due to string movement through the air near the pickup and vibrations from sound waves emitted from the body of the instrument. The transducer and a container filled with ferromagnetic fluid are responsive to the ferrous strings. The container with fluid is also responsive to both the vibrations and sound waves of the body of the instrument. Also, the sound waves from the strings affect the transducer as in the prior art. A more complete perceived sound and sound profile can be produced by the present invention pickup system with an induced magnetic field component from the ferromagnetic fluid-filled container, being responsive to variations in ferrous string movements, wherein the mechanical vibrations due to body resonance, sound waves from the moving strings and even sound waves emitted from the body of the instrument each affect and slightly alter the variable magnetic field.

When the strings are not ferrous strings, the filled container still provides resonance for input into the transducer beyond the prior art systems. The ferromagnetic fluid would even still behave as a fluid to non-ferrous strings, so there is still an impact of the pickup system for varying the perceived sound of the instrument.

With the mounting means or adjustment means part of the mounting means, the pickup system further functions as a vibrational pickup, which can be placed in close proximity to the instrument strings. This string movement produces further input into the electrical signal.

A major consideration of the pickup system is the ability to produce perceived sounds according to the preference of the individual operator. With the cartridge and structures of the present invention, different materials can be used to resonate input into the transducer for the desired perceived sound. As the cartridge is changed, the perceived sound can be changed, without disassembly of the instrument. The selection of a sound profile or perceived sound of an instrument is enhanced by applying different resonant materials with respective sound quality characteristics. Although different materials are already known to affect perceived sound, the present invention discloses a unique cartridge-based system, which can removably attach cartridges to the pickup system. Each cartridge is comprised of a container with a different effect on the electrical signals transmitted from the instrument, including containers with an induced magnetic field effect. In particular, when the container is filled with a ferromagnetic fluid, a magnetic field is induced to affect the transducer and subsequent perceived sound of the instrument.

The present invention to provides an innovative pickup system, which is sensitive to different resonant materials unlike any prior art pickup. The system enhances selection of a sound profile or perceived sound of an instrument by combining magnetic and acoustic effects in a single system. With the induced magnetic field of a ferrofluid filled chamber, the acoustic effects of the material of the chamber cause vibrations in the ferrofluid. These vibrations of the ferrofluid affect the induced magnetic field, which can be transduced into the electrical signal for the perceived sound. The effect is visually perceptible too. The ferromagnetic particles in the ferrofluid align with the magnetic field lines of the induced magnetic field, creating the appearance of a plurality of spikes of particles. Each spike moves with the vibration of the fluid, including vibrations of the fluid caused by the resonance of the container of the first material. Viscosity of the fluid can also affect the character of the perceived sound. The induced magnetic field changes, i.e. vibrations of the spikes, are transduced into an electric signal for created the unique perceived sound of the present invention.

Previously, non-magnetically detectable resonant materials contributed very little to the perceived sound quality of magnetic pickups. The present invention utilizes non-magnetically detectable resonant materials to influence the induced magnetic field, thereby directly contributing to the perceived sound quality characteristics of the pickup. The resonant materials may be selected based on individual preference for their respective sound qualities as detected and transduced by a magnetic pickup. The pickup system of the present invention enables detection of more levels of complexity of sound, analogous to a "hi-def" version of perceived sound.

The pickup system of the present invention provides cartridges that are easy to replace and interchange and containers that are easy to replace and interchange on the cartridges. The removable attachment is an innovation of the present device that allows more options for achieving a desired perceived sound. The speed of changing the pickup is greatly increased due to replacement without taking the instrument to component parts. The pickup system of the present invention has the ability to quickly and efficiently change the perceived sound of the instrument.

The foregoing disclosure and description of the invention is illustrative and explanatory thereof. Various changes in the details of the illustrated construction and method can be made without departing from the true spirit of the invention.

We claim:

1. A pickup system for detecting and converting sound and vibrations from a musical instrument into an electric signal for amplification, broadcasting, and recording, wherein the instrument is comprised of an instrument body, the pickup system comprising:

a transducer means comprised of a housing, a magnet and an electric signal carrier, said transducer means having a magnetic field;

a mounting means attached to said transducer means; and a cartridge means being comprised of a container and an attachment means and being positioned in proximity to said transducer means, said attachment means engaging said container with said transducer means, wherein said container is comprised of a first material, and wherein said container is filled with a second material, said first material and said second material being different from each other, each material affecting the electric signal and having resonant effects, wherein said second material is a fluid, and wherein said container houses said fluid, and wherein said fluid is ferromagnetic, said fluid creating an induced magnetic field complementary to the transducer means, wherein said transducer means is positioned at a distance from said cartridge means so that said induced magnetic field of said cartridge means is complementary to said magnetic field of said transducer means.

2. The pickup system according to claim 1, wherein said electric signal carrier is comprised of a coil of wire.

3. The pickup system according to claim 2, wherein said coil is wound around said magnet.

4. The pickup system according to claim 1, wherein said electric signal carrier has a ratio of inductance to resistivity of at 0.15, wherein inductance in Henrys is divided by resistivity in Kohm at 1.0 Khz.

5. The pickup system, according to claim 1, wherein said magnetic field has a magnetic field strength of at least 550 Gauss at a surface of said housing

6. The pickup system, according to claim 5, wherein said housing further comprises shielding around said magnet and electric signal carrier.

7. The pickup system according to claim 1, wherein said mounting means is comprised of a threaded member engaging said housing of said transducer means, said housing of said transducer means being movable along an axis of said threaded member.

8. The pickup system according to claim 1, wherein said mounting means comprises:

a support means; and an adjustment means having a threaded element engaging said housing of said transducer means and said support member, said housing of said transducer means being movable along an axis of said threaded element.

9. The pickup system according to claim 1, wherein said container is comprised of a plurality of chambers.

10. The pickup system according to claim 1, wherein said container is comprised of said first material and coated with a surface material, said first material and said surface material being different from each other, each material affecting the electric signal.

11. The pickup system according to claim 1, wherein said container is shaped for removable positioning relative to said transducer means.

12. The pickup system according to claim 1, wherein said container has a resonant member means housed in an interior of said container.

13. The pickup system according to claim 1, further comprising:

dampener on an outside of said container

14. The pickup system according to claim 1, further comprising:

a protective cover placed on said container.

15. A method of using a pickup system, said pickup system detecting and converting sound and vibrations from a musical instrument into an electric signal for amplification, broadcasting, and recording, wherein the instrument is comprised of an instrument body, and wherein the pickup system comprises:

a transducer means comprised of a housing, a magnet and an electric signal carrier, said transducer means having a magnetic field;

a mounting means attached to said transducer means; and a cartridge means being comprised of a container and an attachment means and being positioned in proximity to said transducer means, said attachment means engaging said container with said transducer means, the method comprising the steps of:

installing a transducer onto an instrument body of a musical instrument;

attaching a first cartridge in a fixed position relative to said transducer;

detecting and converting sound and vibrations from the musical instrument into an electric signal for amplification, broadcasting, and recording;

removing said first cartridge; and repeating the steps of attaching and removing a subsequent cartridge for achieving a preferred perceived sound.

16. The method of using a pickup system, according to claim 15, wherein the step of installing a transducer comprises:

attaching a support onto the instrument; and securing said transducer housing to the support.

17. The method of using a pickup system, according to claim 15, wherein the step of attaching the cartridge comprises using an attachment to fix a position of said container without disassembly of the musical instrument, and wherein the step of removing the cartridge comprises using said attachment without disassembly of the musical instrument.

* * * * *